United States Patent [19]

Himmelwright et al.

[11] Patent Number: 4,888,273

[45] Date of Patent: Dec. 19, 1989

[54] STABILIZED TABULAR SILVER HALIDE GRAIN EMULSIONS

[75] Inventors: Richard S. Himmelwright, Melrose; Avinash C. Mehta, Belmont; Lloyd D. Taylor, Lexington, all of Mass.

[73] Assignee: Polaroid Corporation, Cambridge, Mass.

[21] Appl. No.: 160,710

[22] Filed: Feb. 26, 1988

[51] Int. Cl.[4] ..... G03C 1/34

[52] U.S. Cl. ..... 430/569; 430/600; 430/603; 430/605; 430/611; 430/615

[58] Field of Search ..... 430/611, 567, 569, 600, 430/603, 605, 613, 615

[56] References Cited

U.S. PATENT DOCUMENTS

| | | | |
|---|---|---|---|
| 2,444,607 | 7/1948 | Heimbach | 95/7 |
| 2,444,609 | 7/1948 | Heimbach et al. | 95/7 |
| 2,449,225 | 9/1948 | Heimbach et al. | 95/7 |
| 2,450,397 | 9/1948 | Heimbach | 95/7 |
| 2,743,180 | 4/1956 | Carroll | 95/7 |
| 2,772,164 | 11/1956 | Allen et al. | 96/109 |
| 2,835,581 | 5/1958 | Tinker et al. | 96/109 |
| 3,161,506 | 12/1964 | Becker | 96/3 |
| 3,333,961 | 8/1967 | Fry et al. | 96/109 |
| 4,063,951 | 12/1977 | Bogg | 96/94 R |
| 4,067,739 | 1/1978 | Lewis | 96/94 R |
| 4,088,494 | 5/1978 | Tani | 430/600 |
| 4,150,994 | 4/1979 | Maternaghan | 96/94 R |
| 4,184,878 | 1/1980 | Maternaghan | 430/567 |
| 4,332,888 | 6/1982 | Corben | 430/570 |
| 4,355,101 | 10/1982 | Mehta et al. | 430/564 |
| 4,390,613 | 6/1983 | Mehta et al. | 430/219 |
| 4,439,520 | 3/1984 | Kufron et al. | 430/434 |
| 4,451,555 | 5/1984 | Pollet et al. | 430/445 |
| 4,477,565 | 10/1984 | Himmelwright | 430/567 |
| 4,478,929 | 10/1984 | Jones et al. | 430/217 |
| 4,720,451 | 1/1988 | Shuto et al. | 430/379 |

OTHER PUBLICATIONS

Duffin, Photographic Emulsion Chemistry, Focal Press, 1966, pp. 66–72.

Photographic Science and Engineering, vol. 5, No. 6, 1961; pp. 332–336.

*Primary Examiner*—Paul R. Michl

*Assistant Examiner*—Mark R. Buscher

*Attorney, Agent, or Firm*—Philip G. Kiely

[57] ABSTRACT

Silver halide emulsions containing tabular silver halide grains are stabilized by the employment of a compound of the formula

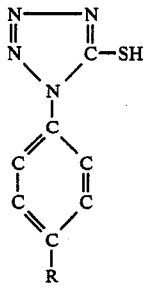

In a preferred embodiment an azaindene is also employed.

7 Claims, No Drawings

STABILIZED TABULAR SILVER HALIDE GRAIN EMULSIONS

FIELD OF THE INVENTION

This invention relates to photographic silver halide emulsions and, more specifically, to silver halide emulsions containing tabular silver halide grains and to the stabilization of such emulsions.

BACKGROUND OF THE INVENTION

Tabular silver halide grains are well known in the art. For example, in Photographic Science and Engineering, Volume 5, No. 6, November-December 1961, Berry, Marino, and Oster study the preparation and growth of silver bromide tabular grains. A discussion of tabular silver bromoiodide emulsions is found in Duffen, Photographic Emulsion Chemistry, Focal Press, 1966, pages 66–72. The patent literature also has dealt extensively with tabular emulsions; for example, Bogg, U.S. Pat. No. 4,063,951 issued Dec. 20, 1977; Lewis, U.S. Pat. No. 4,067,739 issued January, 1978; and Maternaghan, U.S. Pat. Nos. 4,150,994, 4,184,877, and 4,184,878. U.S. Pat. No. 4,439,520, issued Mar. 24, 1984, is directed to high aspect ratio chemically- and spectrally-sensitized tabular grain silver halide emulsions. The emulsions are characterized as having at least 50 percent of the total projected area of the silver halide grains provided by said chemically- and spectrally-sensitized tabular silver halide grains having a thickness of less than 0.3 microns and a diameter of at least 0.6 microns with an average aspect ratio greater than 8.1.

Tabular grains are characterized as having a ratio of diameter to thickness of greater than 1. This ratio is termed "aspect ratio."

U.S. Pat. No. 4,478,929, issued Oct. 23, 1984, is directed to photographic image transfer film units employing a negative working high-aspect ratio tabular grain silver halide emulsion.

It is well known in the art to employ stabilizers to minimize instability in the emulsions either before or after coating, which instability increases fog; that is, the minimum density in the emulsion or in the resulting dye image.

A host of compounds have been employed in the art to stabilize emulsions. One of the most widely-employed class of compounds include the azaindenes as illustrated, for example, in U.S. Pat. Nos. 2,444,607, 2,444,609, 2,449,225, and 2,450,397.

U.S. Pat. Nos. 2,743,180, 2,772,164, 2,835,581, and 3,333,961 are directed to chemically- and optically-sensitive silver halide emulsions employing as anti-foggants or stabilizers specified classes of triazaindenes, tetraazaindenes, and pentaazaindenes.

U.S. Pat. No. 3,161,506 is directed to color diffusion transfer processes which include an optically sensitized silver halide emulsion having a dye developer associated therewith, wherein the emulsion contains a member of the class consisting of hydroxy and amino triazaindenes, hydroxy and amino tetraazeindenes, and hydroxy and amino pentaazaindenes.

Another widely-known and employed stabilizer for emulsions are the mercaptotetrazoles, more specifically 1-phenyl-5-mercaptotetrazole. U.S. Pat. No. 4,332,888, issued June 1, 1982, discloses a method for providing photosensitive silver halide emulsions with enhanced stability employing both a 1-phenyl-5-mercaptotetrazole and a specified azaindene stabilizer.

U.S. Pat. Nos. 4,355,101 and 4,390,613 are directed to specified substituted mercaptotetrazole compounds which are employed as development restrainers in photographic elements and which are particularly useful in diffusion transfer photographic products and processes.

A novel stabilizing system for tabular grains has now been found which is not susceptible to the deficiencies of the prior art.

SUMMARY OF THE INVENTION

Tabular grain silver halide emulsions are stabilized with respect to fog development on storage and during photographic processing by the employment of a substituted phenylmercaptotetrazole of the formula

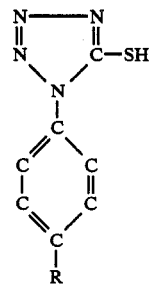

wherein R $= -SO_2NH_2$ I $= -C(CH_3)=N-OH$ II $= -OH$ III $= -SO_2NHCH_3$ IV

V

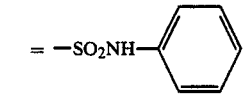

$= -NHSO_2CH_3$ VI

VII

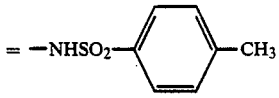

For convenicne herein, these compounds will be referred to as "substituted PMT".

In a preferred embodiment, the emulsions of the present invention also employ an azaindene, preferably a tetraazaindene, added in the finalling step.

DETAILED DESCRIPTION OF THE INVENTION

The employment of 1-phenyl-5-mercaptotetrazole as a stabilizer in tabular grain silver halide emulsions has been found to be unsatisfactory in that the property of the stabilizer to bind strongly to the surface of the grain prevents the attainment of high speeds, even when the stabilizer is employed at low levels. Tetraazaindene compounds were also deficient in stabilizing tabular grain emulsions. The deficiencies of these stabilizers is even more apparent in high pH development systems, such as dye diffusion transfer systems, where the fog problem becomes exaggerated.

By means of the present invention, tabular grain emulsions posses storage stability, i.e., inhibits fog generation, comparable to tetraazaindene stabilized conventional grain emulsions without the disadvantages. The substituted PMT stabilizers also are effective in arresting chemical sensitization thereby further minimizing fog development. The stabilizers of the present invention also function to control interstitial silver ions as well or better than tetraazaindene in conventional emulsions. The levels of the stabilizers of the present invention are also lower than the prior art stabilizers.

In a preferred embodiment, the substituted PMT stabilizers are also employed with an azaindene compound, more preferably hydroxytetraazaindene, in the finalling step.

The stabilizers of the present invention are generally employed at a level of about 0.05 mmol/mol Ag to 10.0 mmol/mol Ag. The stabilizers are added to the emulsions during chemical sensitization, preferably at optimum speed to fog ratio.

The tabular silver halide grains of the present ivention have an aspect ratio of at least 5, preferably at least 10 and more preferably at least 20. The novel stabilizers of the present invention are useful with any of the tabular grain emulsions known to the art.

The following non-limiting examples illustrate the novel method of the present invention.

EXAMPLE 1

Emulsion Preparation

The following solutions were prepared:

| | |
|---|---|
| Solution A | |
| Phthalated gelatin | 54.3 g |
| Water | 1545.7 g |
| Solution B | |
| Silver nitrate | 339.7 g |
| Water | 921.9 g |
| Solution C | |
| Potassium bromide | 238.0 g |
| Water | 913.5 g |
| Solution D | |
| Potassium bromide | 59.5 g |
| Water | 978.4 g |

Solution A was placed in a make vessel at 50° C. To Solution A was added, simultaneously, 500 ml each of Solutions B and C under pAg control at aAg 7.8–8.0 at a flow rate of 50 mL/min. At the end of the addition period, the temperature was raised to 60° C. and about 560 mL of Solution D was added to provide a pAg of about 10.2. The grains were allowed to grow until all of the small feedstock crystals disappeared, which required about 90 min. The grains had an aspect ratio of about 18.

EXAMPLE 2

Control

The emulsion of Example 1 was sensitized with 8.42 μmol/mol Ag of sodium thiosulfate and 12.69 μmol/mol Ag of gold chloride ($AuCl_3$) in the presence of 507.6 μmol/mol Ag of potassium thiocyanate. The emulsion was ripened at 50° C. for 60 minutes. At the end of the sixty minutes the emulsion was cooled to 42° C. and 2.15 mmol/mol Ag of 4-hydroxy-6-methyl-1,3,3a,7-tetraazaindene was added to arrest chemical sensitization. The emulsion was then spectrally sensitized and finalled which included the further addition of 5.02 mmol/mol Ag of the hydroxytetraazaindene.

EXAMPLE 3

Invention

The emulsion of Example 1 was sensitized with 8.42 μmol/mol Ag of sodium thiosulfate and 12.69 μmol/mol Ag of gold chloride ($AuCl_3$) in the presence of 507.6 μmol/mol Ag of potassium thiocyanate. The emulsion was ripened at 50° C. for 60 minutes. At the end of the sixty minutes the emulsion was cooled to 42° C. and 0.44 mmol/mol Ag of

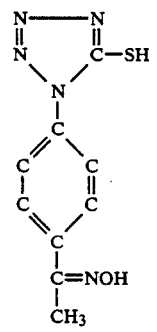

1-(4-acetylphenyl)-2-tetrazoline-5-thione oxime was added to arrest chemical sensitization. The emulsion was then spectrally sensitized and finalled which included the further addition of 5.02 mmol/mol Ag of the hydroxytetraazaindene.

The emulsions were coated as the green sensitized layer of a bichrome element. The following table shows the Dmax and 0.75 intercept speed after 4 days at room temperature and the Dmax change after 3 days in a 49° C. oven.

TABLE

| EXAMPLE | 4 Day Dmax/speed | Δ Dmax after 3 days 49° C. oven |
|---|---|---|
| 2 | 217/231 | −26 |
| 3 | 214/230 | +1 |

From the table it will be seen that while the emulsions are substantially the same initially, the control emulsion stabilized with the hydroxytetraazaindene shows significant loss of stability upon aging while the emulsion of the invention shows no deterioration.

The terms "finalling" and "finalling step", as used herein, are intended to refer to the treatment of the emulsion just prior to coating and may include pH adjustment, viscosity adjustment, and the like.

We claim:

1. A method for stabilizing a photosensitive silver halide emulsion comprised of tabular silver halide grains having an aspect ratio of at least 5 which comprises adding to said emulsion during chemical sensitization a compound of the formula

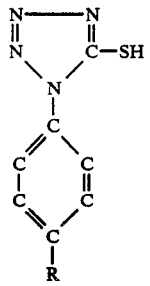

wherein R is $-\underset{\underset{CH_3}{|}}{C}=N-OH$, $-OH$, $-SO_2NHCH_3$,

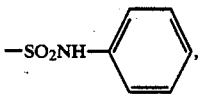

, $-NHSO_2CH_3$, or

-continued

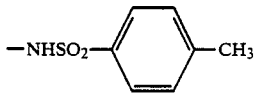

and adding to said emulsion an azaindene subsequent to said chemical sensitization.

2. The method of claim 1 wherein R is $$-\underset{\underset{CH_3}{|}}{C}=N-OH.$$

3. The method of claim 1 wherein R is $-SO_2NH_2$.

4. The method of claim 1 wherein R is $-OH$.

5. The method of claim 1 wherein said azaindene is an hydroxytetraazaindene.

6. The method of claim 1 wherein said silver halide grains are sensitized to red, green or blue light.

7. The method of claim 1 wherein said tabular silver halide grains have an aspect ratio of at least 10.

* * * * *